United States Patent [19]

Okazaki et al.

[11] 4,141,729

[45] Feb. 27, 1979

[54] 1,3,4-OXADIAZOLE DERIVATIVES AND ELECTROPHOTOGRAPHIC PLATES CONTAINING SAME

[75] Inventors: Mitsuo Okazaki, Tama; Akihiro Yamaguchi, Yokohama; Masaomi Sasaki, Tokyo, all of Japan

[73] Assignee: Ricoh Company, Ltd., Tokyo, Japan

[21] Appl. No.: 796,221

[22] Filed: May 12, 1977

[30] Foreign Application Priority Data

May 18, 1976 [JP] Japan ..... 51-56830
May 18, 1976 [JP] Japan ..... 51-56832

[51] Int. Cl.[2] ..... G03G 5/04; G03G 5/09
[52] U.S. Cl. ..... 96/1.5 R; 260/307 G
[58] Field of Search ..... 96/1.5 R; 260/307 G

[56] References Cited

U.S. PATENT DOCUMENTS

| | | | |
|---|---|---|---|
| 2,733,245 | 1/1956 | Ainsworth | 260/307 G X |
| 3,189,447 | 6/1965 | Neugebauer et al. | 96/1.5 R |
| 3,556,785 | 1/1971 | Baltazzi | 96/1.6 |
| 3,719,480 | 3/1973 | Brantly | 96/1.5 R X |
| 3,839,034 | 10/1974 | Wiedemann | 96/1.5 R |
| 3,871,882 | 3/1975 | Wiedemann | 96/1.5 R |
| 3,884,691 | 5/1975 | Rochlitz | 96/1.5 R X |
| 3,977,870 | 8/1976 | Rochlitz | 96/1.5 R |
| 3,989,520 | 11/1976 | Rochlitz | 96/1.5 R |
| 4,026,704 | 5/1977 | Rochlitz et al. | 96/1.5 R |
| 4,028,102 | 6/1977 | Rochlitz et al. | 96/1.5 R |

FOREIGN PATENT DOCUMENTS 1337228 11/1973 United Kingdom ..... 96/1.5 R

*Primary Examiner*—Roland E. Martin, Jr.
*Attorney, Agent, or Firm*—Blanchard, Flynn, Thiel, Boutell & Tanis

[57] ABSTRACT

1,3,4-oxadiazole derivative expressed by the general formula wherein R represents alkyl having 1–4 carbon atoms, dialkylamino having 1–4 carbon atoms, diarylamino, phenyl, styryl, halogenophenyl, nitrophenyl, alkylphenyl having 1–4 carbon atoms, alkoxyphenyl having 1–4 carbon atoms, cyanophenyl, carboxylic ester substituted phenyl, dialkylaminophenyl having 1–4 carbon atoms, naphthyl, anthryl, or heterocyclic radical, is a photoconductive substance with high sensitivity and is a compound useful as a constituent of electrophotographic plate.

28 Claims, 3 Drawing Figures

1,3,4-OXADIAZOLE DERIVATIVES AND ELECTROPHOTOGRAPHIC PLATES CONTAINING SAME

BACKGROUND OF THE INVENTION (a) Field of the Invention

The present invention relates to 1,3,4-oxadiazole derivatives and the use thereof in electrophotographic plates.

(b) Description of the Prior Art

There have recently been developed a variety of highly sensitive electrophotographic plates comprising a combination of charge-generating material with charge-transport material as effective constituents. For instance, U.S. Pat. Nos. 3,791,826 and 3,837,851 describe electrophotographic plates having a photosensitive layer comprising a combination of a charge-generating layer consisting of inorganic photoconductive substance with a charge-transport layer consisting of 2,4,7-trinitro-9-fluorenone or triaryl pyrazoline compound.

Also, U.S. Pat. Nos. 3,764,315 and 3,879,200 describe electrophotographic plates having a photosensitive layer formed by dispersing charge-generating pigment in a charge-transport material. To date, varieties of useful charge-generating materials have been proposed, but as for the charge-transport material, truly useful ones have scarcely been proposed. Besides, the art of using asymmetric 1,3,4-oxadiazole compounds as a charge-transport material is unprecedented.

SUMMARY OF THE INVENTION

A principal object of the present invention is to provide novel 1,3,4-oxadiazole derivatives which are excellent charge-transport materials and which can be easily manufactured.

Another object of the present invention is to provide an electrophotographic plate which comprises a 1,3,4-oxadiazole derivative as charge-transport material.

The 1,3,4-oxadiazole derivatives according to the present invention are compounds expressed by the following general formula

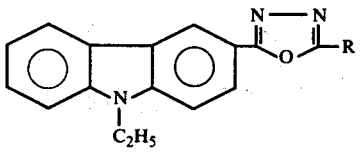

[I]

wherein R represents alkyl having 1–4 carbon atoms, dialkyl amino having 1–4 carbon atoms, diarylamino, phenyl, styryl, halogenophenyl, nitrophenyl, alkylphenyl having 1–4 carbon atoms, alkoxyphenyl having 1–4 carbon atoms, cyanophenyl, carboxylic ester substituted phenyl, dialkylaminophenyl having 1–4 carbon atoms, naphthyl, anthryl, or heterocyclic radical.

These compounds can be easily obtained by subjecting 5-[3-(9-ethyl)carbazolyl]tetrazole expressed by the general formula

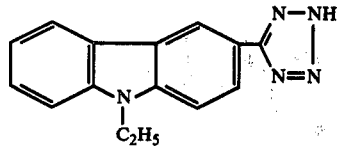

to denitrification/ring-closure reaction with carboxylic halide expressed by the general formula

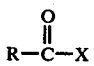

wherein R represents the same as in the foregoing general formula [I], and X represents halogen atom, within an organic solvent.

As the organic solvent for this purpose, common solvents such as pyridine, N,N-dimethyl formamide, dimethyl sulfoxide, benzene, toluene, xylene, ethyl benzene, chlorobenzene, etc. will suffice.

As for the conditions for the reaction, the appropriate temperature for reaction is in the range of from 50° to 150° C. or thereabouts and the appropriate time for reaction is in the range of from 15 minutes to 3 hours or thereabouts. The reaction may be effected while stirring. The appropriate ratio of said 5-[3-(9-ethyl)carbazolyl]tetrazole to carboxylic halide is in the range of 1:1–4 or thereabouts in terms of mole ratio. In this context, 5-[3-(9-ethyl)carbazolyl]tetrazole for use in the reaction is a novel compound (in the form of a white acicular crystal having a melting point in the range of from 260.5° to 261.5° C.), and this compound can be easily manufactured by heating and recycling 3-cyano-9-ethly carbazole together with sodium azide in an amount ranging from practically equivalent mole to 4 moles per mole of said carbazole, within N,N'-dimethyl formamide, dimethyl sulfoxide or methyl cellulose, in the presence of lithium chloride or ammonium chloride in an amount of equal gram equivalent relative to said sodium azide.

To cite applicable carboxylic halides, there are acetyl chloride, dimethyl carbamoyl chloride, diethyl carbamoyl chloride, diphenyl carbamoyl chloride, cinnamoyl chloride, α-naphthoyl chloride, β-naphthoyl chloride, anthracene-9-carbonyl chloride, nicotinoyl chloride, isonicotinoyl chloride, 2-furoyl chloride, 2-quinoxaloyl chloride, benzoyl chloride, p-nitrobenzoyl chloride, p-toluoyl chloride, p-methoxybenzoyl chloride, o-methoxybenzoyl chloride, p-butoxybenzoyl chloride, p-carbomethoxybenzoyl chloride, p-carbomethoxybenzoyl chloride, p-carbobutoxybenzoyl chloride, p-dimethyl aminobenzoyl chloride, p-diethyl aminobenzoyl chloride, p-cyanobenzyl chloride, etc.

The manufacturing method as above has a merit that the intended 5-[3-(9-ethyl)carbazolyl]-1,3,4-oxadiazole derivatives of high purity can be produced at a high yield by simple reacting operation and particularly without resorting to any refining operation.

As 1,3,4-oxadiazole derivatives expressed by the foregoing general formula, such substances as follows can be cited.

(1)
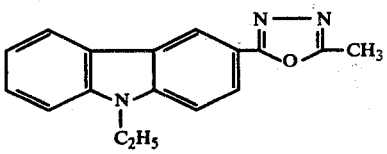
(2)
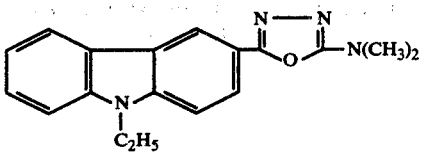
(3)
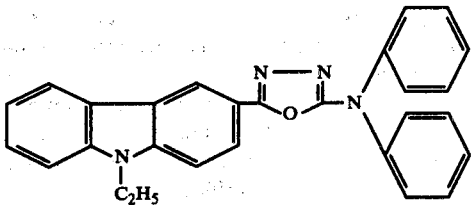
(4)
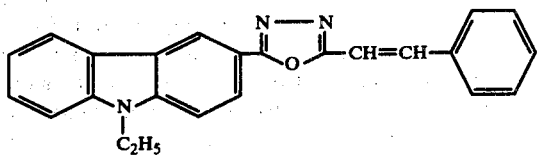
(5)
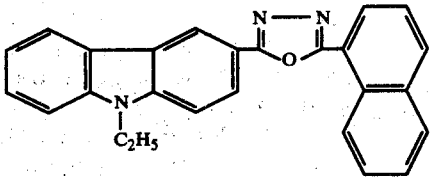
(6)
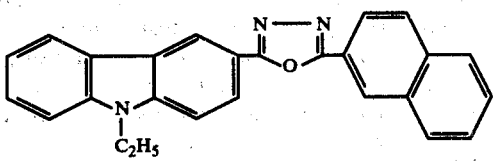
(7)
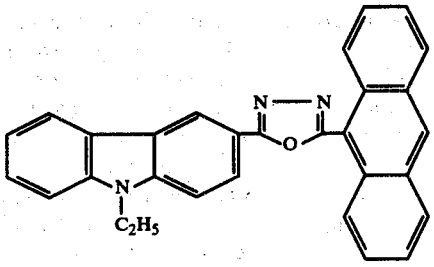
(8)
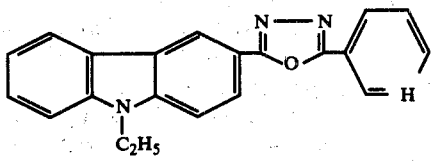
(9)
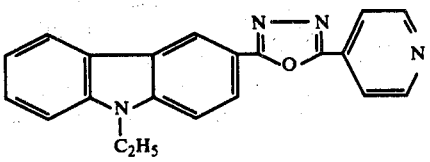
-continued
(10)
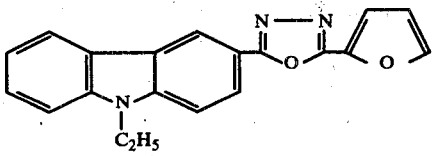
(11)
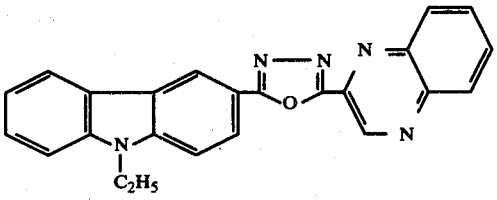
(12)
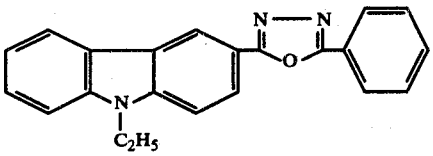
(13)
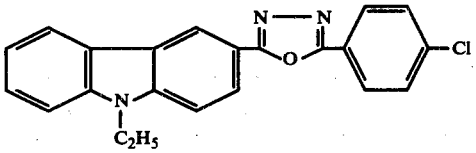
(14)
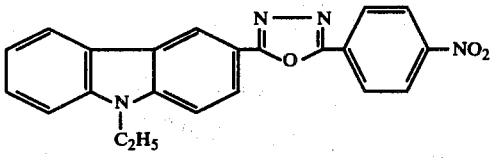
(15)
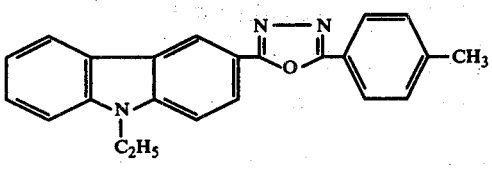
(16)
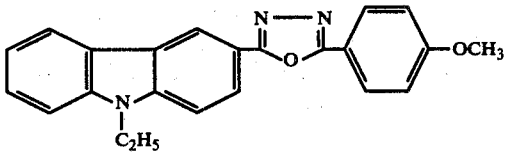
(17)
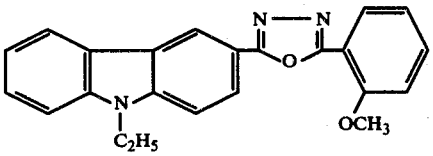
(18)
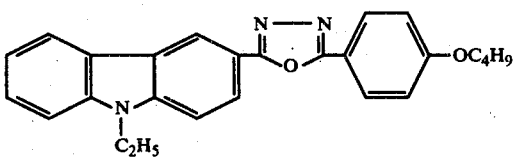
(19)
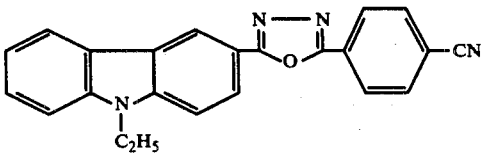

-continued (20)

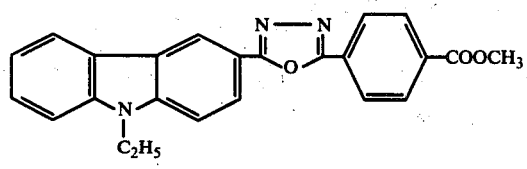

(21)

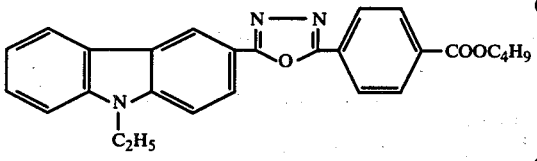

(22)

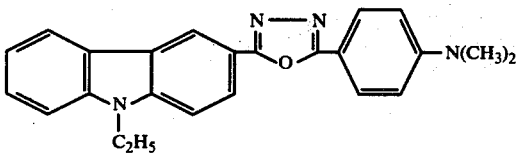

(23)

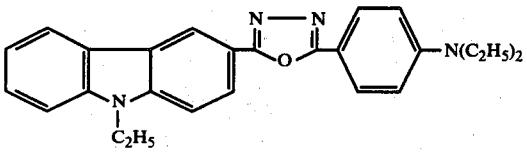

(24)

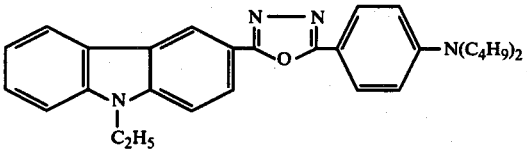

1,3,4-oxadiazole derivatives according to the present invention work effectively as charge-transport material for electrophotographic plates. This charge-transport material is used in combination with a charge-generating material. Electrophotographic plates comprising a combination of these two materials are classified into the following two types.

The electrophotographic plate of type-1 is one consisting of a conductive support and a photosensitive layer having a thickness of about 3–50μ formed on said support by dispersing a pigment as charge-generating material in a mixture consisting of charge-transport material and binding agent. The conductive support for this purpose includes metal plate such as aluminum plate, stainless steel plate, iron plate, nickel plate, etc. or glass plate, plastic plate or paper with a metal deposited thereon through evaporation, or plastic plate or paper processed for conductivity by coating a conductive agent thereon. As the applicable charge-generating material, there are varieties of inorganic substances such as Se, SeTe, SeTeAs, CdS, and cadmium sulfaselenide disclosed in U.S. Pat. No. 3,764,315, and various organic pigments are also applicable. These organic pigments include, for instance, cyanine dye, phthalocyanine dye, disazo dye, indigoid dye, quinacridine dye, polynuclear quinone dye, bis-benzimidazole dye, perylene dye, methine dye, azo dye, xanthene dye and violanthrone dye described in U.S. Pat. Nos. 3,775,105, 3,850,630, 3,870,516, 3,877,935, 3,879,200, 3,887,366, 3,894,868 and 3,904,407, Japanese Patent Publication Nos. 30332/1972, 3754/1972 and 70538/1973, etc. As the applicable binding agent, there are known varieties of organic high-molecular compounds. To cite instances of useful high-molecular compounds, there are such resins as polyamide, polyurethane, acetal resin, butylral resin, polyester, epoxide resin, alkyd resin, polyketone, polycarbonate, polyvinyl ketone, polystyrene, polyacryl amide, polyethylene, polybutadiene, polyvinyl chloride, maleic resin, acrylic resin, methacrylic resin, silicone resin, poly-N-vinyl carbazole, polyvinyl pyrene, polyvinyl anthracene, polyvinyl benzocarbazole, pyrene-formaldehyde resin, bromopyrene-formaldehyde resin and ethyl carbazole-formaldehyde resin, cellulose, gelatin, etc.

In order to prepare an electrophotographic plate of type-1, it will do to follow the procedure in which the binding agent and 1,3,4-oxadiazole derivative are dissolved in a solvent such as toluene, tetrahydrofuran, etc., a pigment as charge-generating material is added to the resulting solution and dispersed thoroughly therein by means of a ball-mill or the like, and the thus obtained mixture solution is coated on the surface of the aforesaid support and dried thereafter thereby forming a photosensitive layer. Said 1,3,4-oxadiazole derivative according to the present invention for use as charge-transport material is desirably contained in an amount of about 30–80% based on the gross weight of the photosensitive layer. And, as for the amount of the photoconductive pigment, to wit, the pigment as charge-generating material, application of a surprisingly small amount thereof can bring about a sensitivity well sufficient for electrophotographic process. Therefore, there is no necessity for adding the pigment as charge-generating material in a large amount, that is, the amount thereof to be applied is in the range of from less than 50% to more than 5% at the utmost based on the gross weight of the photosensitive layer.

The electrophotographic plate of type-2 is one consisting of a conductive support, a first layer consisting essentially of charge-generating material formed on said support, and a second layer (i.e., charge-transport layer) comprising charge-transport material and binding agent formed on said first layer. As the support, the charge-generating material and the binding agent therein, those substances described in the foregoing with regard to the electrophotographic plate of type-1 are applicable. In order to form the charge-generating layer, in the case of employing a charge-generating material which can be deposited through evaporation such as Se, SeTe, SeTeAs, cadmium sulfoselenide, etc., it is preferable to form said layer on the support by depositing through evaporation: in the case of employing a charge-generating material other than these substances, or employing the aforesaid inorganic material as occasion demands, said inorganic material is dispersed in a dispersion medium, the resulting solution is coated on the support, and then said dispersion medium is evaporated, whereby the charge-generating layer is formed. In this case, it also will do to dissolve a small amount of the aforesaid binding agent in the dispersion medium beforehand. Accordingly, it is possible to make this charge-generating layer very thin, thereby realizing an appropriate thickness in the range of about 0.1–5μ. Increase or decrease of the thickness beyond this range will not lead to any practical result. Further, this charge-generating layer can be composed of plural layers such as taught in U.S. Pat. No. 3,791,826. Anyhow, on the charge-generating layer there is additionally formed on the charge-transport layer. In order to form this charge-transport layer, it will do to follow the procedure in which said binding agent and 1,3,4-oxadiazole derivative are dissolved in a solvent to prepare a coating solution, and the thus prepared coating solution is applied to the charge-generating layer and dried thereafter. The thickness of this charge-transport layer is desirably in the range of about 3–50μ: increase of the thickness beyond 50μ will entail a lowering of sensitivity, while decrease of the thickness beyond 3μ will entail a lessening of mechanical strength of the photosensitive layer (i.e., charge-generating layer plus charge-transport layer). In this context, it is desirable that the 1,3,4-oxadiazole derivative constituting the charge-transport layer accounts for about 30–90% of the gross weight of said charge-transport layer.

In both electrophotographic plates of type-1 and type-2, it is possible to provide a barrier layer consisting of, for instance, aluminum oxide as taught in U.S. Pat. No. 3,791,826 by interposing same inbetween the photosensitive layer and the support.

BRIEF DESCRIPTION OF THE DRAWINGS

In the appended drawings.

DESCRIPTION OF THE PREFERRED EMBODIMENTS

Example 1

A mixture consisting of 80.0 g (0.36 mole) of 3-cyano-9-ethyl carbazole, 24.7 g (0.38 mole) of sodium azide, 16.1 g (0.38 mole) of lithium chloride and 1200 ml of methyl cellosolve was heated and refluxed for 24 hours while stirring. After cooling down to room temperature, the reaction product was poured in 3.5 l of water, whereby a uniform solution was obtained. When this solution was treated with undiluted hydrochloride acid to attain a pH value of 4–5, there was separated a white-colored precipitate. The thus treated solution was then filtered after cooling with ice water down to less than 10° C., whereby there were obtained crude crystals. These crude crystals wee washed in water several times and dried thereafter. The yield of crystals was 79.0 g (yield rate: 82.5%), and the melting point thereof was in the range of 258.5°–259.5° C. (decomposition point).

When these crude crystals were next recrystallized by employing N,N-dimethyl formamide~water mixture solvent, there were obtained white-colored acicular crystals having a melting point in the range of 260.5°–261.5° C. (decomposition point). It was confirmed through the following analysis that this product was 5-[3-(9-ethyl)carbazolyl]tetrazole.

| Elementary analysis: | C | H | N |
|---|---|---|---|
| value calculated for $C_{15}H_{13}N_5$ | 68.41% | 4.99% | 26.60% |
| value found | 68.20% | 5.01% | 26.52% |

Figure 1:
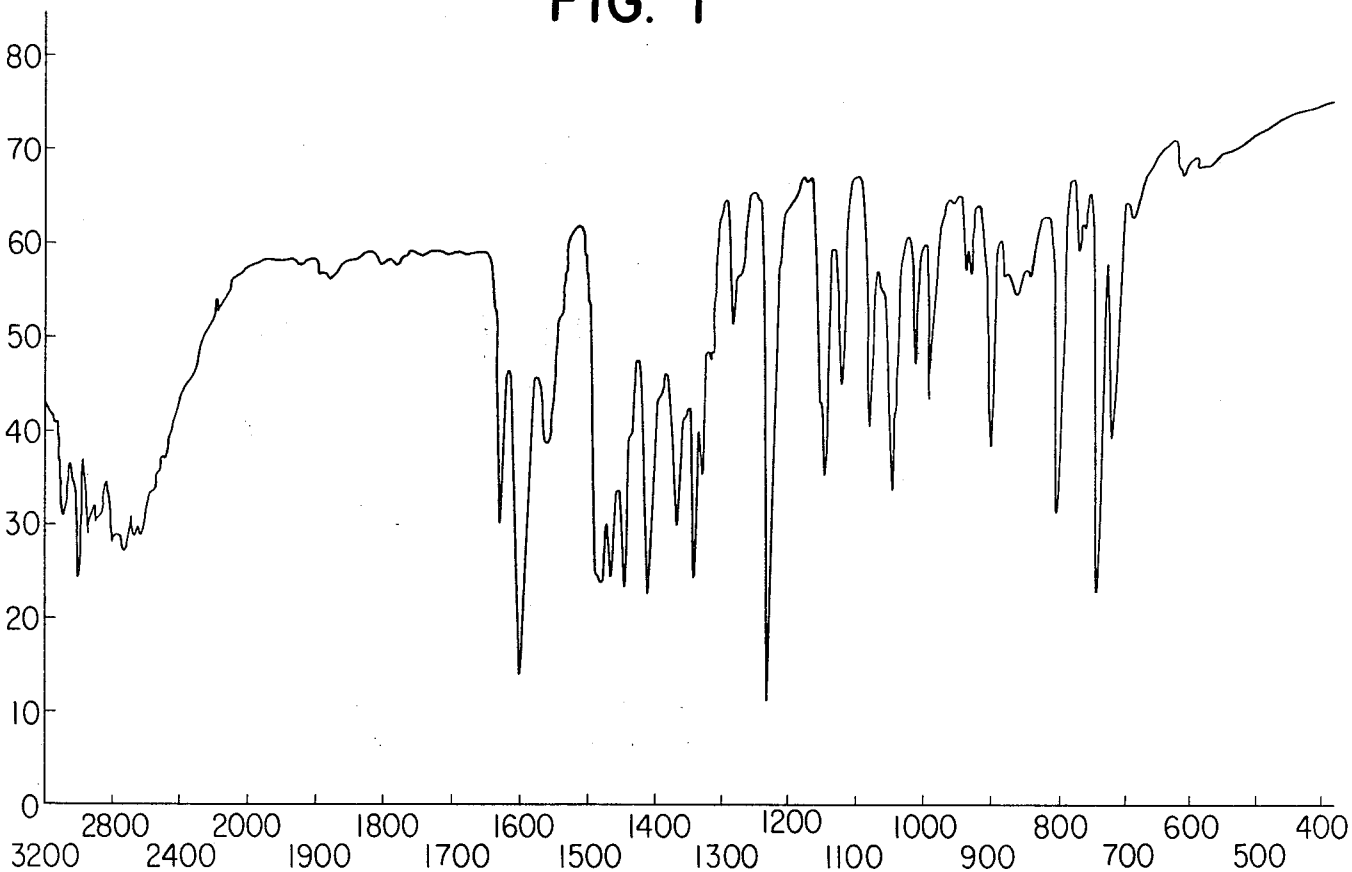
FIG. 1 is a diagram of the infrared (IR) spectrum of 5-[3-(9-ethyl)carbazolyl]tetrazole obtained in the following Example 1.

IR spectrum (according to KBr tablet method) of this product was as shown in FIG. 1.

Next, a mixture consisting of 1.0 g (3.8 millimole) of the thus obtained 5-[3-(9-ethyl)carbazolyl]tetrazole, 6.0 g (7.6 millimole) of acetyl chloride and 20 ml of pyridine was heated and refluxed for 30 minutes. When the thus reacted mixture was poured in 100 ml of water after cooling it down to room temperature and then 2 ml of 5% aqueous solution of caustic soda was added thereto, there was separated a white-colored precipitate. This precipitate was then filtered, washed in water and dried thereafter, whereby crude crystals were obtained. The yield of crude crystals was 9.0 g (yield rate: 91.0%), and the melting point thereof was in the range of 126°–7.0° C. Next, these crude crystals were recrystallized by employing benzene~n-hexane mixture solvent, whereby there were obtained white-colored acicular crystals having a melting point in the range of 127°–8.5° C. This product was identified with 2-methyl-5-[3-(9-ethyl)carbazolyl]-1,3,4-oxadiazole based on the following data.

| Elementary analysis: | C | H | N |
|---|---|---|---|
| value calculated for $C_{17}H_{15}ON_3$ | 73.63% | 5.45% | 15.15% |
| value found | 73.66% | 5.43% | 15.17% |

Figure 2:
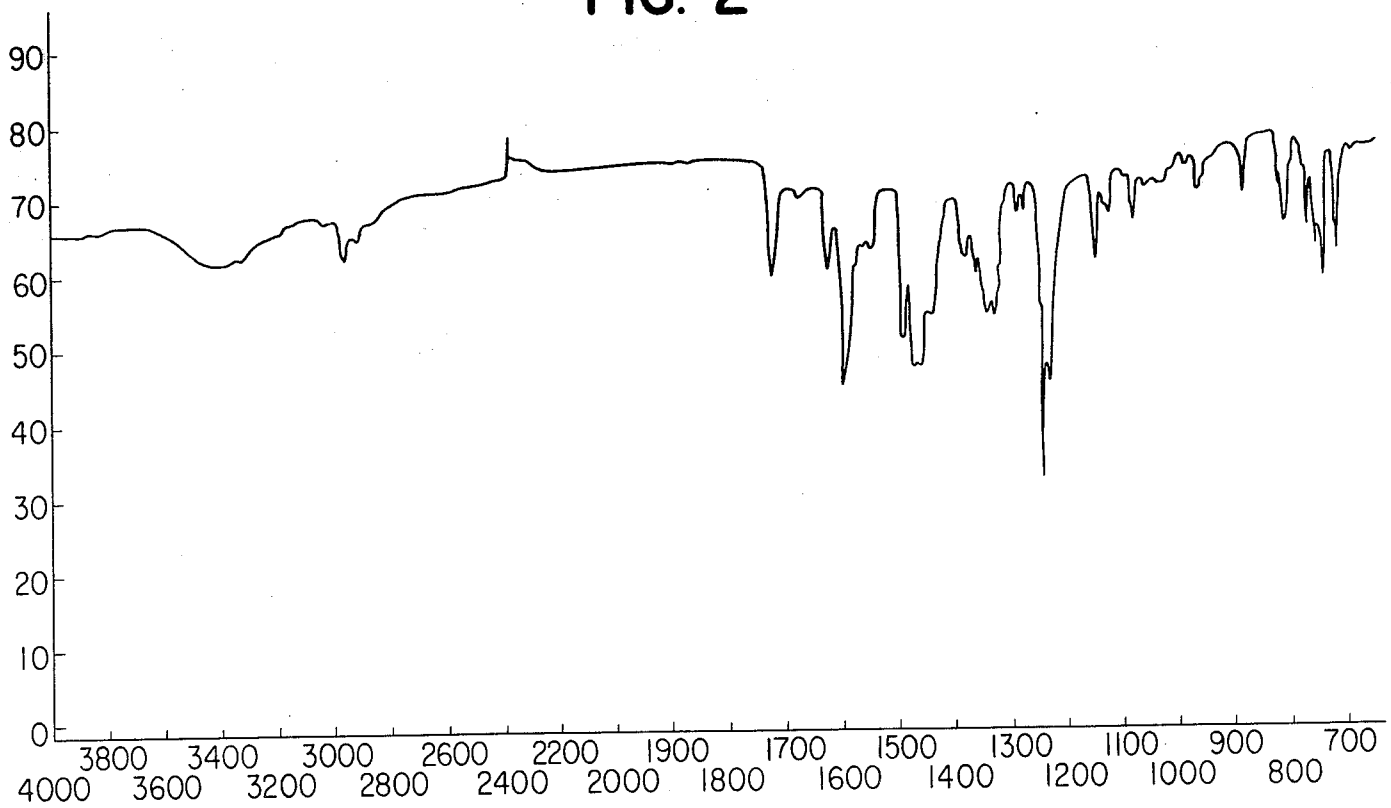
FIG. 2 is a diagram of the IR spectrum of the 2-methyl-5-[3-(9-ethyl)carbazolyl]-1,3,4-oxadiazole obtained in Example 1.

IR spectrum (according to KBr tablet method) of this product was as shown in FIG. 2.

$\nu_{C-O-C}$ ($cm^{-1}$) 970

EXAMPLES 2–11

Varieties of 5-[3-(9-ethyl)carbazolyl]-1,3,4-oxadiazole derivatives were manufactured through the same procedure as in Example 1 except for application of the compounds shown in the following table as $R_1COX$. In this connection, the yield rate and the melting point in the table signify that of refined product, respectively.

| Ex. No. | $R_1COX$ | Product | Yield rate (%) | Melting point (° C) | Elementary analysis value found (%) (value calculated) C | H | N | IR spectrum (by KBr tablet method) $\nu_{C-O-C}$ ($cm^{-1}$) |
|---|---|---|---|---|---|---|---|---|
| 2 | dimethyl carbamoyl chloride | 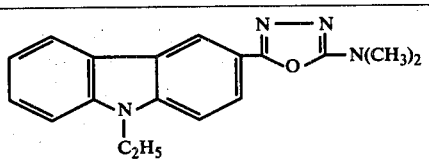 | 83.2 | 147.0 – 8.0 | 70.49 (70.56) | 5.91 (5.92) | 18.32 (18.29) | 960 |
| 3 | diphenyl carbamoyl chloride | 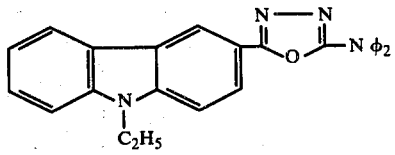 | 85 – 85.5 | 155.0 – 6.0 | 78.1 (78.12) | 5.09 (5.15) | 12.96 (13.01) | 960 |

-continued

| Ex. No. | $R_1COX$ | Product | Yield rate (%) | Melting point (°C) | Elementary analysis value found (%) (value calculated) C | H | N | IR spectrum (by KBr tablet method) $\nu_{C-O-C}$ ($cm^{-1}$) |
|---|---|---|---|---|---|---|---|---|
| 4 | cinnamoyl chloride | 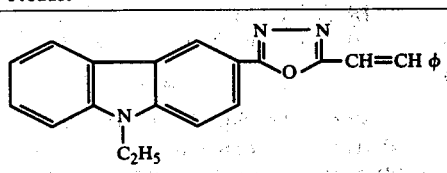 | 82.3 | 156.0 - 7.5 | 78.92 (78.88) | 5.18 (5.24) | 11.39 (11.50) | 970 |
| 5 | α-naphthoyl chloride | 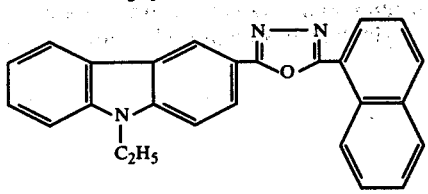 | quantitative | 192.0 - 3.5 | 80.20 (80.18) | 4.89 (4.92) | 10.82 (10.79) | 965 |
| 6 | β-naphthoyl chloride | 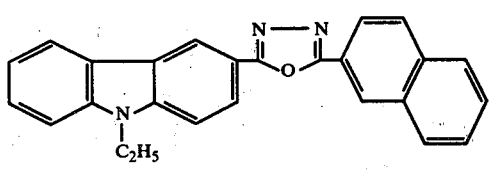 | 93.5 | 211.5 - 2.0 | 80.19 (80.18) | 4.90 (4.92) | 10.80 (10.79) | 965 |
| 7 | 9-anthryl chloride | 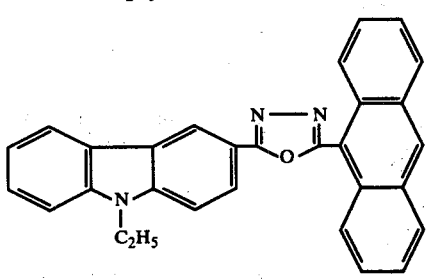 | 97.0 | 281 - 2.0 | 82.00 (81.98) | 4.81 (4.82) | 9.57 (9.56) | 965 |
| 8 | nicotinic chloride | 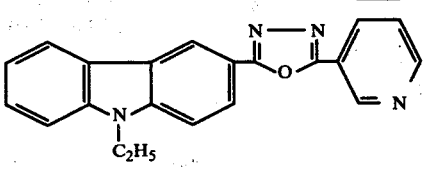 | 92.7 | 177.0 - 8.5 | 74.08 (74.10) | 4.72 (4.74) | 16.56 (16.46) | 965 |
| 9 | isonicotinic chloride | 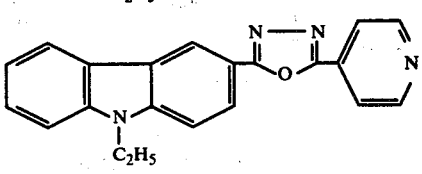 | 98.5 | 183.5 - 4.5 | 74.09 (74.10) | 4.73 (4.74) | 16.48 (16.46) | 960 |
| 10 | 2-fluoyl chloride | 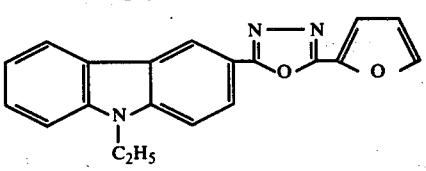 | 92.0 | 157.5 - 9.0 | 72.89 (73.93) | 4.60 (4.59) | 12.86 (12.76) | 970 |
| 11 | 2-quinoxaloyl chloride | 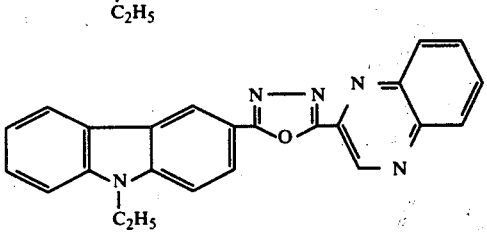 | 81.2 | 253.0 - 4.0 | 73.66 (73.64) | 4.40 (4.38) | 17.90 (17.89) | 970 |

Remarks:
1. The bracketed value in the table represents calculated value.
2. The value in the brackets are of elementary analysis of Cl (%).

Example 12

A mixture consisting of 1.0 g (3.8 millimole) of 5-[3-(9-ethyl)carbazolyl]tetrazole obtained in Example 1, 0.7 g (4.98 millimole) of benzoyl chloride and 20 ml of pyridine was heated and refluxed for 15 minutes. When the thus reacted mixture was cooled down to room temperature and was poured in 100 ml of water thereafter, there were separated white-colored acicular crystals. Then, these crude crystals were filtered, washed in water several times and dried thereafter. The yield of crude crystals was 1.20 g (yield rate: 92.5%), and the melting point thereof was in the range of 160.5°-161.5° C. Next, these crude crystals were recrystallized by employing ethanol, whereby there was obtained 2-phenyl-5-[3-(9-ethyl) carbazolyl]-1,3,4-oxadiazole in the form of white-colored acicular crystals having a melting point in the range of 162.0°-162.5° C.

| Elementary analysis: | C | H | N |
|---|---|---|---|
| value calculated for $C_{22}H_{17}ON_3$: | 77.85% | 5.05% | 12.38% |
| value found: | 77.90% | 5.04% | 12.37% |

Figure 3:
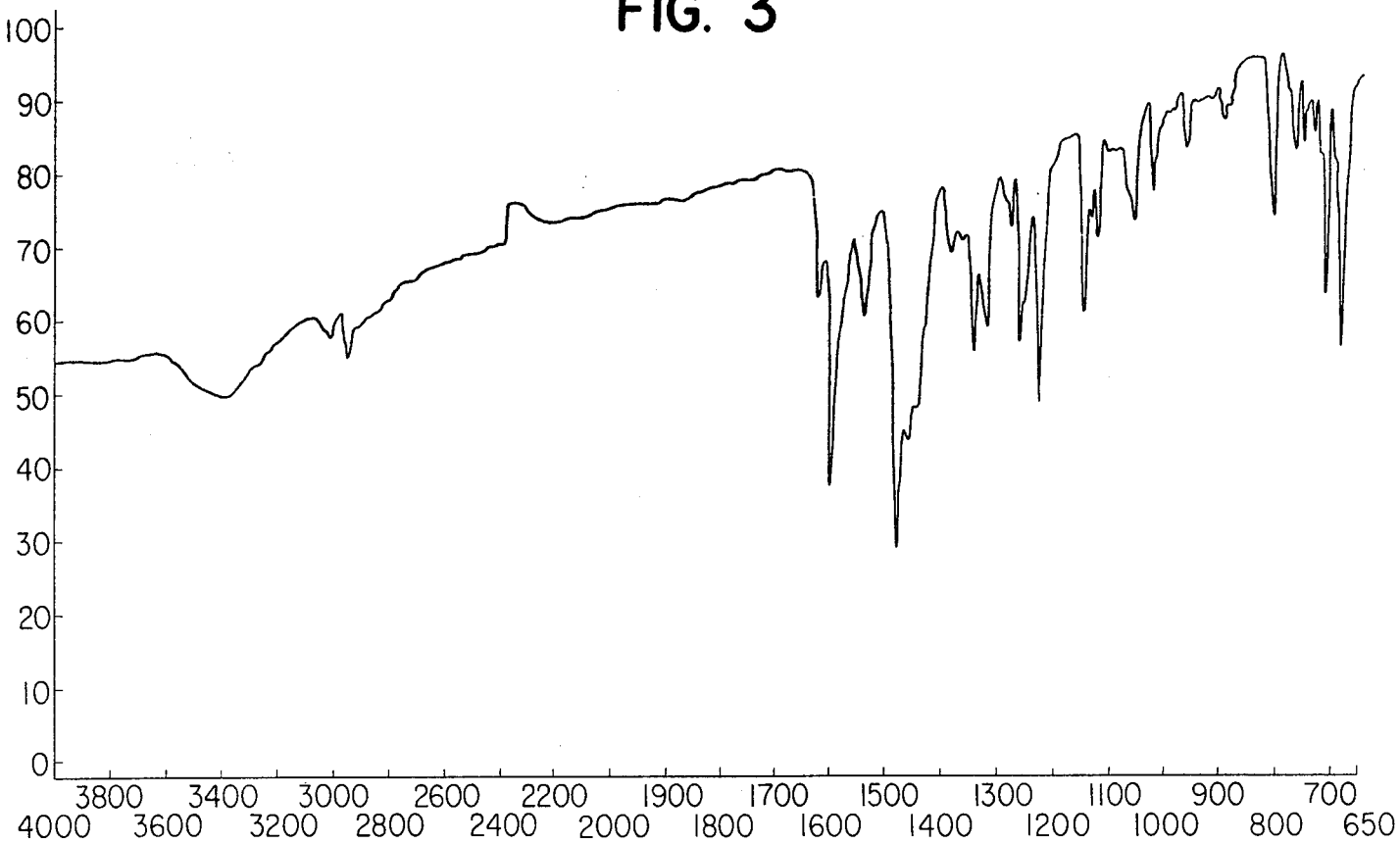
FIG. 3 is a diagram of IR spectrum of 2-phenyl-5-[3-(9-ethyl)carbazolyl]-1,3,4-oxadiazole obtained in the following Example 12.

IR spectrum (according to KBr tablet method) of this product was as shown in FIG. 3.

Examples 13-24

Varieties of 5-[3-(9-ethyl)carbazolyl]-1,3,4-oxadiazole derivative were manufactured through the same procedure as in Example 12 except for application of carboxylic halides shown in the following table.

| Ex. No. | $R_1$-phCOX | Product | Yield rate (%) | Melting point (° C) | Elementary analysis value found (%) (value calculated) C | H | N | IR spectrum (by KBr tablet method) $\nu_{C-O-C}$ ($cm^{-1}$) |
|---|---|---|---|---|---|---|---|---|
| 13 | p-chlorobenzoyl chloride | 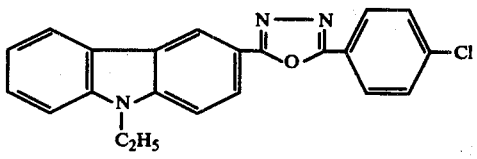 | 93.5 | 161 - 2.0 | 70.58 (70.66) | 4.31 (4.32) | 11.25 (11.24) | 960 |
| 14 | p-nitrobenzoyl chloride | 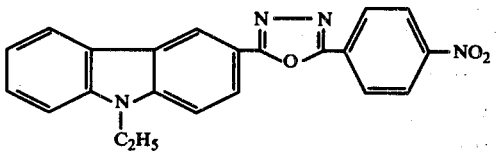 | 95 - 99 | 236.0 - 7.0 | 68.63 (68.74) | 4.30 (4.20) | 14.60 (14.58) | 960 |
| 15 | p-toluyl chloride | 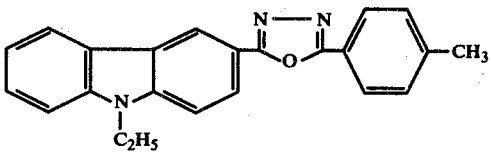 | 94.0 | 157.0 - 8.0 | 78.20 (78.16) | 5.41 (5.42) | 11.82 (11.89) | 965 |
| 16 | p-methoxybenzoyl chloride | 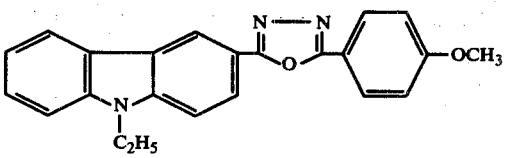 | 96.4 | 163.5 - 5.0 | 74.80 (74.78) | 5.09 (5.18) | 11.48 (11.38) | 965 |
| 17 | p-butoxybenzoyl chloride | 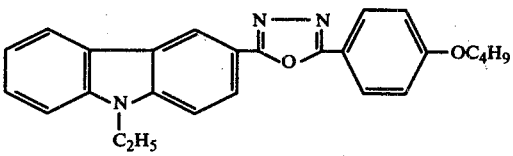 | 91.0 | 121.0 - 3.0 | 75.85 (75.89) | 6.12 (6.12) | 10.20 (10.21) | 965 |
| 18 | p-cyanobenzoylchloride | 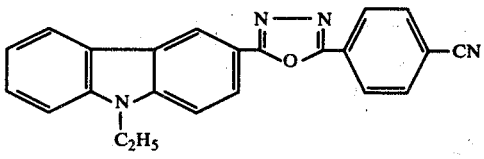 | 95.1 | 211 - 2.0 | 75.85 (75.81) | 4.41 (4.43) | 15.40 (15.38) | 960 |
| 19 | o-methoxybenzoyl chloride | 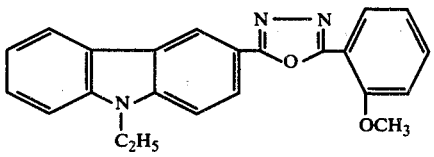 | 92.3 | 162.5 - 3.5 | 74.81 (74.78) | 5.15 (5.18) | 11.40 (11.38) | 965 |

-continued

| Ex. No. | $R_1$-phCOX | Product | Yield rate (%) | Melting point (° C) | Elementary analysis value found (%) (value calculated) C | H | N | IR spectrum (by KBr tablet method) $\nu_{C-O-C}$ ($cm^{-1}$) |
|---|---|---|---|---|---|---|---|---|
| 20 | p-carbomethoxybenzoyl chloride | 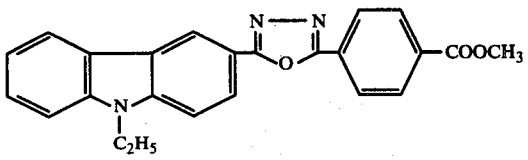 | 92.7 | 196.5 - 8.0 | 72.43 (72.53) | 4.81 (4.82) | 10.61 (10.57) | 970 |
| 21 | p-carbobutoxybenzoyl chloride | 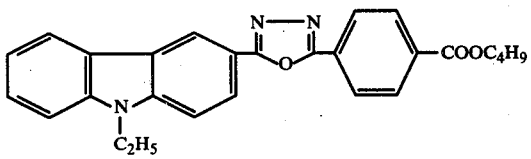 | 89.5 | 175 - 6.0 | 73.81 (73.78) | 5.70 (5.73) | 9.49 (9.56) | 970 |
| 22 | p-dimethylaminobenzoyl chloride | 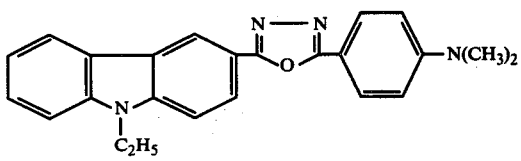 | 92.5 | 168.5 -70.0 | 75.40 (75.37) | 5.81 (5.80) | 14.64 (14.65) | 955 |
| 23 | p-dibutylaminobenzoyl chloride | 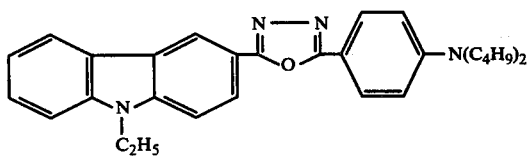 | 91.0 | 112 - 3.0 | 77.10 (77.22) | 7.33 (7.35) | 12.06 (12.01) | 955 |
| 24 | p-diethylaminobenzoyl chloride | 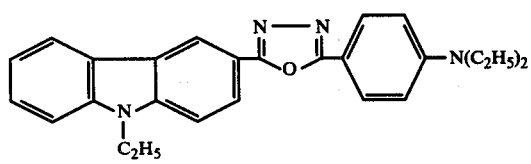 | 90.5 | 139.0 -40.0 | 76.05 (76.07) | 6.28 (6.38) | 13.61 (13.65) | 955 |

Example 25

98 Parts of tetrahydrofuran were added to 2 parts of Dian Blue (C.I. 21180), and the mixture was thoroughly crushed and dispersed by means of a ball-mill, whereby a charge-generating pigment dispersion was obtained. This dispersion was then coated on a polyester film deposited with aluminum through evaporation by means of a doctor blade and was dried naturally thereafter, whereby a 1μ-thick charge-generating layer was formed. Subsequently, a charge-transport layer forming liquid obtained by mixing 2 parts by weight of the compound obtained in Example 3, 3 parts by weight of polycarbonate (namely, Panlite L, the manufacture of K.K. TEIJIN) and 45 parts by weight of tetrahydrofuran was coated on the foregoing charge-generating layer by means of a doctor blade and dried thereafter for 30 minutes at 100° C. to form a 9μ-thick charge-transport layer, whereby a photosensitive material according to the present invention was prepared.

Next, by the use of an electrostatic copying paper testing apparatus (namely, Model SP 128, the manufacture of K.K. KAWAGUCHI DENKI SEISAKUSHO), this photosensitive material was charged positively by 20 seconds' corona discharge of +6 KV, the thus charged material was left standing in a dark place for 20 seconds, the surface potential Vpo (V) thereat was measured, light was applied by means of a tungsten lamp so as to attain the illumination of 20 luxes on the surface of the material, and the time required for reducing said surface potential Vpo to half was sought, whereby the amount of exposed E ½ was obtained. The result was as follows.

Vpo = −960 V, E ½ = 5.4 lux·sec.

Examples 26–36

Varieties of photosensitive materials were prepared by applying the same procedure as in Example 25 save for employing oxadiazole compounds shown in the following Table-1 in lieu of the oxadiazole compound used in Example 25 which was obtained in Example 3. When these photosensitive materials were subjected to the same measurement as in Example 25, the result was as shown in Table-1.

Table-1

| Example No. | Oxadiazole compound (as signified by Example No.) | −Vpo (volt) | E ½ (lux.sec) |
|---|---|---|---|
| 26 | 1 | 700 | 10.5 |
| 27 | 4 | 1050 | 5.1 |
| 28 | 6 | 980 | 7.9 |
| 29 | 8 | 650 | 11.0 |
| 30 | 10 | 1100 | 21.0 |

Table-1-continued

| Example No. | Oxadiazole compound (as signified by Example No.) | −Vpo (volt) | E ½ (lux.sec) |
|---|---|---|---|
| 31 | 11 | 900 | 8.5 |
| 32 | 15 | 950 | 6.0 |
| 33 | 16 | 1050 | 5.0 |
| 34 | 19 | 980 | 6.5 |
| 35 | 20 | 900 | 11.3 |
| 36 | 24 | 1000 | 3.4 |

Example 37

By depositing selenium through vacuum evaporation to the extent of 1μ in thickness on an aluminum plate having a thickness of about 300μ, a charge-generating layer was formed. Next, a charge-transport layer forming liquid was prepared by mixing 2 parts of the oxadiazole compound obtained in Example 4, 3 parts of polyester resin (namely, POLYESTER ADHESIVE 49000, the manufacture of Du Pont Inc.) and 45 parts of tetrahydrofuran together. Subsequently, this liquid was coated on the foregoing charge-generating layer (selenium-deposited layer) by means of a doctor blade, dried naturally thereafter, and further dried under reduced pressure to form a 10μ-thick charge-transport layer, whereby a photosensitive material according to the present invention was prepared.

When this photosensitive material was measured with respect to Vpo and E ½ through the same procedure as in Example 25, Vpo was −900 V, and E ½ was 4.3 lux·sec.

Examples 38–46

Varieties of photosensitive materials were prepared by applying the same procedure as in Example 37 save for employing oxadiazole compounds shown in the following Table-2 in lieu of the oxadiazole compound used in Example 37 which was obtained in Example 4. When these photosensitive materials were subjected to the same measurement as in Example 25, the result was as shown in Table-2, respectively.

Table-2

| Example No. | Oxadiazole compound (as signified by Example No.) | −Vpo (volt) | E ½ (lux.sec) |
|---|---|---|---|
| 38 | 2 | 780 | 10.5 |
| 39 | 3 | 820 | 7.5 |
| 40 | 5 | 1050 | 7.0 |
| 41 | 7 | 890 | 9.5 |
| 42 | 14 | 920 | 17.0 |
| 43 | 17 | 950 | 5.5 |
| 44 | 22 | 1000 | 5.1 |
| 45 | 23 | 990 | 3.5 |
| 46 | 24 | 1015 | 2.9 |

Example 47

158 Parts of tetrahydrofuran were added to 1 part of β-type copper phthalocyanine (namely, SUMITOMO Cyanine Blue LBG, the manufacture of SUMITOMO KAGAKU K.K. ), and the mixture was thoroughly crushed and dispersed by means of a ball-mill. Thereafter, 12 parts of the oxadiazole compound obtained in Example 24 and 18 parts of polyester resin (namely, POLYESTER ADHESIVE 49000) were added to the thus treated mixture and dispersed therein, whereby a photosensitive layer forming liquid was prepared. This liquid was then coated on a polyester film deposited with aluminum through evaporation by means of a doctor blade and was dried for 30 minutes at 100° C. to form a 16μ-thick photosensitive layer, whereby a photosensitive material according to the present invention was prepared.

When this photosensitive material was charged negatively by corona discharge of +6 KV by the use of the same apparatus as used in Example 25, and was measured with respect to Vpo and E ½, the result was as follows.

Vpo = +830 V, E ½ = 2.9 lux·sec.

Examples 48–58

Varieties of photosensitive materials were prepared by applying the same procedure as in Example 47 save for employing oxadiazole compounds shown in the following Table-3 in lieu of the oxadiazole compound used in Example 47 which was obtained in Example 24. When these photosensitive materials were subjected to the same measurement as in Example 25, the result was as shown in Table-3, respectively.

Table-3

| Example No. | Oxadiazole compound (as signified by Example No.) | +Vpo (volt) | E ½ (lux.sec) |
|---|---|---|---|
| 48 | 3 | 890 | 5.2 |
| 49 | 4 | 910 | 3.0 |
| 50 | 5 | 900 | 3.9 |
| 51 | 6 | 850 | 4.1 |
| 52 | 7 | 920 | 6.2 |
| 53 | 9 | 700 | 19.5 |
| 54 | 11 | 800 | 12.0 |
| 55 | 15 | 830 | 5.4 |
| 56 | 16 | 880 | 3.5 |
| 57 | 18 | 950 | 11.0 |
| 58 | 22 | 900 | 2.0 |

What is claimed is:

1. An electrophotographic plate comprising an electrically conductive support and a photoconductive layer overlying said electrically conductive support, said photoconductive layer consisting essentially of a mixture of a charge-generating pigment, a compound having the formula

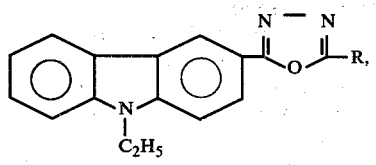

wherein R is diarylamino.

2. An electrophotographic plate according to claim 1, wherein R is diphenylamino.

3. An electrophotographic plate according to claim 2, wherein said charge-generating pigment is a member selected from the group consisting of Se, SeTe, SeAs, SeTeAs, CdS, cadmium sulfoselenide, cyanine dye, phthalocyanine dye, disazo dye, indigoid dye, quinacridone dye, polynuclear quinone dye, bis-benzimidazole dye, perylene dye, methine dye, azo dye, xanthene dye and violanthrone dye.

4. An electrophotographic plate according to claim 2, wherein the thickness of said photoconductive layer is in the range of about 3 to 5μ.

5. An electrophotographic plate according to claim 2, wherein said binding agent is a member selected from the group consisting of polyamide, polyurethane, acetal resin, butyral resin, polyester, epoxide resin, alkyd resin, polyketone, polycarbonate, polyvinyl ketone, polystyrene, polyacrylamide, polyethylene, polybutadiene, polyvinyl chloride, maleic resin, acrylic resin, methacrylic resin, silicone resin, poly-N-vinyl carbazole, polyvinyl pyrene, polyvinyl anthracene, polyvinyl benzocarbazole, pyrene-formaldehyde resin, bromopyrene-formaldehyde resin, ethyl carbazole-formaldehyde resin, cellulose and gelatin.

6. An electrophotographic plate according to claim 2, wherein said compound and said charge-generating pigment are contained in an amount of about 30–80% and about 5–50%, respectively, based on the gross weight of the photoconductive layer.

7. An electrophotographic plate comprising an electrically conductive support, a charge-generating layer overlying said electrically conductive support and a charge-transport layer overlying said charge-generating layer, said charge-transport layer consisting essentially of a mixture of a compound having the formula

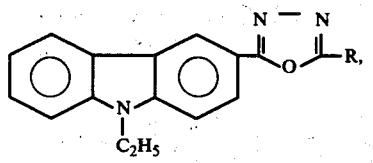

wherein R is diarylamino.

8. An electrophotographic plate according to claim 7, wherein R is diphenylamino.

9. An electrophotographic plate according to claim 8, wherein said charge-generating layer is composed of a member selected from the group consisting of Se, SeAs, SeTe, SeTeAs, cadmium sulfoselenide, phthalocyanine dye, cyanine dye, disazo dye, indigoid dye, quinacridone dye, polynuclear quinone dye, bis-benzimidazole dye, perylene dye, methine dye, azo dye, xanthene dye and violanthrone dye.

10. An electrophotographic plate according to claim 8, wherein the thickness of said charge-generating layer is in the range of 0.1 to 5$\mu$, and the thickness of said charge-transport layer is in the range of about 3 to 50$\mu$.

11. An electrophotographic plate according to claim 8, wherein said charge-generating layer is formed by depositing through evaporation.

12. An electrophotographic plate according to claim 8, wherein the amount of said compound is about 30 to 90% based on the gross weight of said charge-transport layer.

13. An electrophotographic plate according to claim 8, wherein said binding agent is a member selected from the group consisting of polyamide, polyurethane, acetal resin, butyral resin, polyester, epoxide resin, alkyd resin, polyketone, polycarbonate, polyvinyl ketone, polystyrene, polyacrylamide, polyethylene, polybutadiene, polyvinyl chloride, maleic resin, acrylic resin, methacrylic resin, silicone resin, poly-N-vinyl carbazole, polyvinyl pyrene, polyvinyl anthracene, polyvinyl benzocarbazole, pyrene-formaldehyde resin, bromopyrene-formaldehyde resin, ethyl carbazole-formaldehyde resin, cellulose and gelatin.

14. An electrophotographic plate comprising an electrically conductive support and a photoconductive layer overlying said electrically conductive support, said photoconductive layer consisting essentially of a mixture of a charge-generating pigment, a compound having the formula

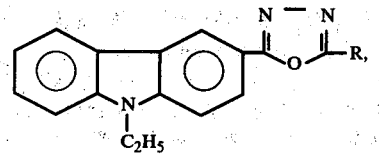

wherein R is dialkylamino in which said alkyl has 1 to 4 carbon atoms, and a binding agent.

15. An electrophotographic plate according to claim 14, wherein said charge-generating pigment is a member selected from the group consisting of Se, SeTe, SeAs, SeTeAs, CdS, cadmium sulfoselenide, cyanine dye, phthalocyanine dye, disazo dye, indigoid dye, quinacridone dye, polynuclear quinone dye, bis-benzimidazole dye, perylene dye, methine dye, azo dye, xanthene dye and violanthrone dye.

16. An electrophotographic plate according to claim 14, wherein the thickness of said photoconductive layer is in the range of about 3 to 50$\mu$.

17. An electrophotographic plate according to claim 14, wherein said binding agent is a member selected from the group consisting of polyamide, polyurethane, acetal resin, butyral resin, polyester, epoxide resin, alkyd resin, polyketone, polycarbonate, polyvinyl ketone, polystyrene, polyacrylamide, polyethylene, polybutadiene, polyvinyl chloride, maleic resin, acrylic resin, methacrylic resin, silicone resin, poly-N-vinyl carbazole, polyvinyl pyrene, polyvinyl anthracene, polyvinyl benzocarbazole, pyrene-formaldehyde resin, bromopyrene-formaldehyde resin, ethyl carbazole-formaldehyde resin, cellulose and gelatin.

18. An electrophotographic plate according to claim 14, wherein said compound and said charge-generating pigment are contained in an amount of about 30–80% and about 5–50%, respectively, based on the gross weight of the photoconductive layer.

19. An electrophotographic plate comprising an electrically conductive support, a charge-generating layer overlying said electrically conductive support and a charge-transport layer overlying said charge-generating layer, said charge-transport layer consisting essentially of a mixture of a compound having the formula

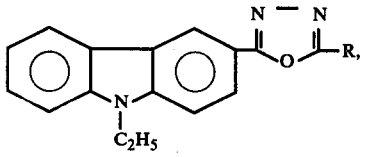

wherein R is dialkylamino in which said alkyl has 1 to 4 carbon atoms, and a binding agent.

20. An electrophotographic plate according to claim 19, wherein said charge-generating layer is composed of a member selected from the group consisting of Se, SeAs, SeTe, SeTeAs, cadmium sulfoselenide, phthalocyanine dye, cyanine dye, disazo dye, indigoid dye, quinacridone dye, polynuclear quinone dye, bis-benzimidazole dye, perylene dye, methine dye, azo dye, xanthene dye and violanthrone dye.

21. An electrophotographic plate according to claim 19, wherein the thickness of said charge-generating layer is in the range of 0.1 to 5$\mu$, and the thickness of said charge-transport layer is in the range of about 3 to 50μ.

22. An electrophotographic plate according to claim 19, wherein said charge-generating layer is formed by depositing through evaporation.

23. An electrophotographic plate according to claim 19, wherein the amount of said compound is about 30 to 90% based on the gross weight of said charge-transport layer.

24. An electrophotographic plate according to claim 19, wherein said binding agent is a member selected from the group consisting of polyamide, polyurethane, acetal resin, butyral resin, polyester, epoxide resin, alkyd resin, polyketone, polycarbonate, polyvinyl ketone, polystyrene, polyacrylamide, polyethylene, polybutadiene, polyvinyl chloride, maleic resin, acrylic resin, methacrylic resin, silicone resin, poly-N-vinyl carbazole, polyvinyl pyrene, polyvinyl anthracene, polyvinyl benzocarbazole, pyrene-formaldehyde resin, bromopyrene-formaldehyde resin, ethyl carbazole-formaldehyde resin, cellulose and gelatin.

25. A compound having the formula

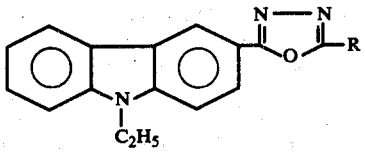

wherein R is dialkylamino in which said alkyl has 1 to 4 carbon atoms.

26. A compound according to claim 25, having the formula

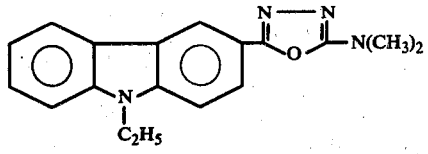

27. A compound having the formula

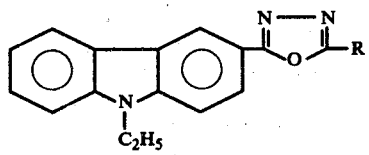

wherein R is diarylamino.

28. A compound according to claim 27, having the formula

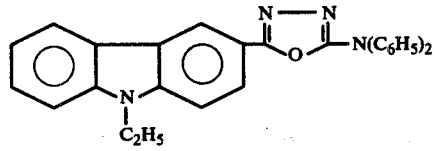

* * * * *

UNITED STATES PATENT AND TRADEMARK OFFICE

CERTIFICATE OF CORRECTION

PATENT NO. : 4 141 729

DATED : February 27, 1979

INVENTOR(S) : Mitsuo Okazaki et al

It is certified that error appears in the above-identified patent and that said Letters Patent are hereby corrected as shown below:

Column 16, line 65; change "5μ" to ---50μ---.

Signed and Sealed this

*Twenty-ninth* Day of *May 1979*

[SEAL]

*Attest:*

RUTH C. MASON
*Attesting Officer*

DONALD W. BANNER
*Commissioner of Patents and Trademarks*